United States Patent [19]

Henzl

[11] 4,073,228

[45] Feb. 14, 1978

[54] TRASH COMPACTOR

[76] Inventor: Jerry Henzl, R.R., 2, Box 191, Effingham, Ill. 62401

[21] Appl. No.: 681,587

[22] Filed: Apr. 29, 1976

[51] Int. Cl.[2] ..... B30B 15/16

[52] U.S. Cl. ..... 100/52; 100/53; 100/99; 100/100; 100/214; 100/229 A; 100/269 R

[58] Field of Search ..... 100/52, 53, 229 A, 229 R, 100/100, 99, 214, 269 R; 92/146; 60/DIG. 10

[56] References Cited

U.S. PATENT DOCUMENTS

| | | | |
|---|---|---|---|
| 3,368,478 | 2/1968 | Clar | 100/229 A |
| 3,463,079 | 8/1969 | Corbett | 100/229 R |
| 3,741,108 | 6/1973 | Stratman | 100/229 A |
| 3,765,148 | 10/1973 | Ippolito | 100/229 A |
| 3,831,513 | 8/1974 | Tashman | 100/53 |
| 3,853,053 | 12/1974 | Grunewald | 100/229 A |
| 3,918,359 | 11/1975 | Hennells | 100/229 A |

*Primary Examiner*—Billy J. Wilhite
*Attorney, Agent, or Firm*—Charles F. Voytech

[57] ABSTRACT

A trash compactor using a dolly as a receptacle for the trash to be compacted. The dolly is normally spring supported ready for movement into and out of the compactor, but when in the compactor and subjected to compacting pressure, the dolly is pressed downwardly, upon the beams of the main compactor frame which then takes the full compacting pressures.

A novel construction of the dolly and compactor floor of the main frame makes such transfer of load possible. The compacting pressure is developed by four hydraulic cylinders, all of which are mounted on a common plate. The rod ends of the two center cylinders are connected to the top member of the main frame and the cylinder ends are connected to the common plate. The rod ends of the remaining two cylinders are connected to the main compacting plate with the cylinder ends mounted on the common plate. With the four cylinders mounted in this manner, twice the movement of the compacting ram is obtained. Safety devices include a deflection switch actuated when a deflection exceeding a given amount takes place within the frame assembly. Such deflection may be caused by solid materials, such as logs, bricks, etc., inadvertently placed in the material to be compacted. Under normal conditions, the cylinders will reverse and the unit will automatically stop once the cylinders reach the limit of their upward stroke. A magnetic switch and latch operated switches serves to prevent operation of the ram unless the trash loading door and dolly are in the closed and latched position.

10 Claims, 8 Drawing Figures

TRASH COMPACTOR

This invention relates to trash or refuse compactors which use hydraulically operated, readily available cylinders for effecting the compaction of the refuse.

The storage of refuse or trash pending removal by a scavenger presents both space and handling problems. It is generally agreed that these problems can be minimized by compacting the refuse to reduce its volume and to form a coherent mass which is readily handled. Thus, compactors proposed and presently available are provided with a ram which is either mechanically activated as by a screw, or pressure fluid operated as by a hydraulic cylinder. The trash itself is placed in a bag in a receptacle either in a removable box or in a drawer from which the compacted mass is withdrawn and carried to a scavenger.

Home compactors are relatively small and do not present serious space problems. For stores, restaurants, hospitals or the like, which generate may more times the trash encountered in the home, space requirements for the compactor can become serious. This is so because the compactor is generally a single cabinet in which the compacting mechanism, the trash receiving receptacle and the loading space are located one above the other, thus creating a tall cabinet.

An object of this invention is the provision of a trash compactor which is appreciably shorter than would normally be required by the travel of the compacting ram, the height of the loading space between the ram and trash receptacle, and the depth of the receptacle itself.

Once the trash is compacted, the problem of removing the compacted mass from the compactor arises. In commercial establishments, for which the compactor of this invention is particularly intended, the quantity of trash generated daily may be considerable, creating a weight problem for the person who empties the compactor. Ideally, the trash should be compacted in a wheeled container in that upon completion of the compaction, the trash can be wheeled out of the compactor to the disposal area where the container can be emptied in any convenient manner.

Another object of this invention, therefore, is to provide a wheeled container or dolly in which trash can be compacted wherein the dolly is constructed to rest upon the bottom of the compactor main frame during the compacting cycle of the device, the pressure of the ram being taken between that bottom bean and an upper beam of the compactor so as to relieve the wheels of the dolly of the greater part of the compacting pressure; all without interfering with the ability of the dolly to be wheeled out of the compactor to a disposal area when the compacting cycle is completed.

A more specific object is the provision of a dolly for a compactor wherein the dolly has a front panel forming a portion of the front of the compactor when the dolly is in operative position therein, and with means for preventing the operation of the compacting mechanism unless the dolly is locked in operative position in the compactor.

Yet another specific object is to provide a dolly for a compactor wherein the dolly is provided with a trash container, the bottom of which is elevated from the floor, and a transverse frame is provided on the dolly below and spaced from the bottom to which frame the wheels of the dolly are secured.

Another object of this invention is to provide safety devices for a trash compactor which prevent the operation of the compactor unless both the access door to the compacting chamber and the dolly in which the trash is compacted are locked in place in the compactor.

Another specific object of this invention is the provision of means for halting the operation of a compactor when the deflection of a compaction thrust receiving member exceeds a predetermined value.

These and other objects of this invention will become apparent from the following detailed descriptions of a preferred embodiment thereof when taken together with the accompanying drawings in which.

Briefly stated, the preferred embodiment of this invention is comprised of a metal framework providing two side by side vertical compartments of unequal frontal width, the smaller containing a motor-driven pump, solenoid-operated valves, and hoses, and the larger compartment containing an upper hydraulic cylinder chamber in which is also disposed the compacting ram, a central loading chamber and a lower trash container chamber.

In the upper chamber, four hydraulic cylinders are provided, two of which have their rods connected to a fixed main frame beam in the chamber and their cylinders connected to a vertically movable support plate. The remaining two cylinders have their rods connected to a pressure plate and their cylinders fixed to the support plate.

The central loading chamber is disposed below the pressure plate when the latter is retracted so that the loading chamber is free of obstructions. A front door on the cabinet of the compactor swings in a horizontal direction to provide access to the chamber.

The lower trash container chamber is open at the front and has a fore-and-aft slot in its bottom extending about half-way across the chamber to receive a strut on the trash container.

The trash container is rectangular in horizontal outline and has a front wall which is finished in a manner to match the front wall of the compactor cabinet. The container front wall is thus a part of the cabinet wall. The container has in effect, a double bottom. The bottom of the trash container chamber is received between the two bottoms of the trash container. The lower bottom of the trash container is supported on spring mounted casters so that as compacting pressure is imposed upon the upper bottom of the container, the spring mounting is compressed to lower the container upon the bottom of the chamber. Thereafter, compacting pressure is taken by the compactor bottom and not by the casters.

The controls include safeguards for the operator and for the metal framework of the compactor. For the operator, the safeguards comprise series switches operated by latches on the loading door and trash container front to prevent operation of the cylinders unless the loading door is closed and latched, and the trash container is latched in place in the compactor. A magnetic switch controlled by the position of the loading door provides additional protection for the operator in the event that the door is inadvertently opened during the compacting cycle. For the metal framework, the safeguard is comprised of a micro-switch mounted on or near a vertical frame member and operated by the deflection of the cross beam to which two of the hydraulic cylinders have their rods connected. When the deflection exceeds a predetermined amount, the cylinders are reversed and pressure on the frame is thus relieved.

Figure 1:
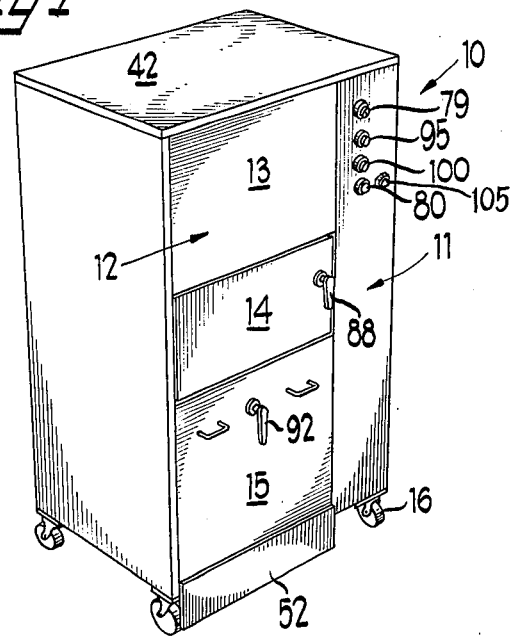
FIG. 1 is a left-front elevational view in perspective of the exterior of the compactor.

Referring now to the drawings for a detailed description of the invention, the compactor is in the form of a cabinet 10 divided vertically into two chambers of unequal width (FIG. 1), the narrower chamber of which is outlined at the front at 11 and the wider chamber at 12. The latter houses the cylinders, support or mounting plate and compaction plate. The wider chamber 12 is divided into upper, loading and trash container chambers which are outlined by a panel 13, a loading door 14 and a trash container front panel 15, respectively. Cabinet 10 is mounted on casters 16 for portability, but these may be replaced with, or supplemented by levelling screws (not shown) if desired, in the manner commonly adopted for household kitchen appliances.

Figure 3:
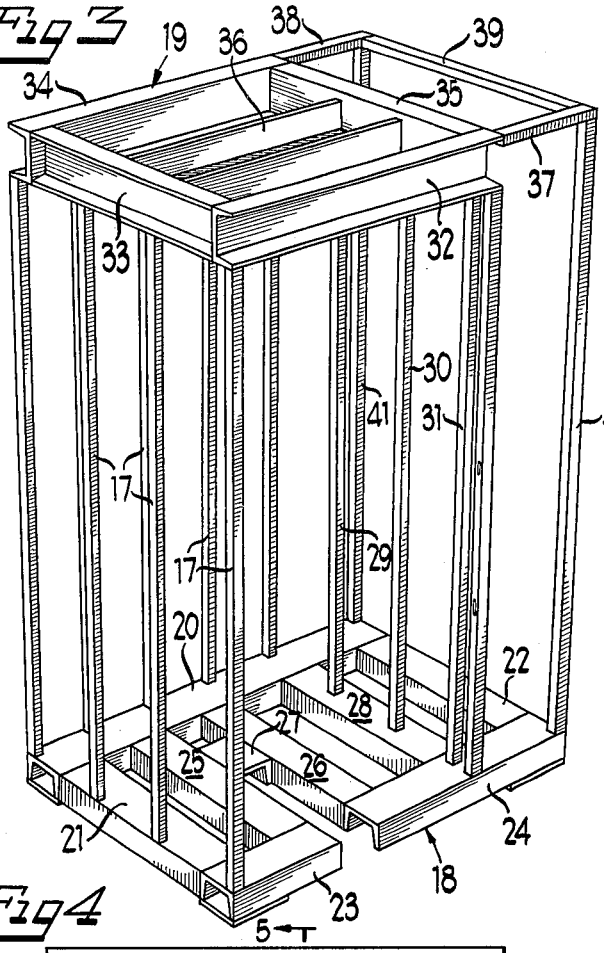
FIG. 3 is a left-front elevational view in perspective of the frame of the compactor.

The frame of cabinet 10 is shown in FIG. 3. It is comprised of vertical portspreferably made of steel square section tubes 17, 29, 30, 31, 40 and 41 welded to a base 18 and top 19 to form an integral frame.

Base 18 is comprised of inverted channel section steel members welded together and providing a rear member 20, two side members 21, 22 and two aligned but spaced front members 23, 24. The adjacent ends of front member 23, 24 are connected to rear member 20 by inverted channel section steel braces 25, 26 and the latter are connected together to the rear of their mid-sections by a short inverted channel section steel strut 27. A third brace 28 connects front and rear members 24 and 20 and supports vertical steel square section tubes 29, 30 and 31 which form the frame members for the partition between narrow chamber 11 and wide chamber 12.

It may be observed that the spacing between front members 23 and 24, and between braces 25 and 26, together with strut 27 forms a slot, the function of which will be described hereinafter.

Top 19 is comprised of front, rear and side steel channel sectioned members 32, 33, 34 and 35 respectively, all disposed on their sides and welded together to form a rectangle defining the wider chamber 12. A single brace 36, comprised of a steel channel-sectioned member disposed parallel with the front and rear members 32, 34 and substantially midway therebetween, is welded at its ends to side members 33, 34 and substantially midway therebetween, is welded at its ends to side members 33, 35. Brace 36 has its open side up and provides the support for the hydraulic compacting cylinders hereinafter to be described.

Narrow chamber 11 is defined at its top by horizontally disposed front and rear steel square tubes 37, 38 welded at their outer ends to side tube 39 and at their inner ends to side member 35. Tubes 37, 38 and 39 are preferably of the same cross sectional size as the vertical tubes 17 and 28–31. Two vertical square tubes 40 and 41 provide the corner supports for the top of narrow chamber 11.

Figure 4:
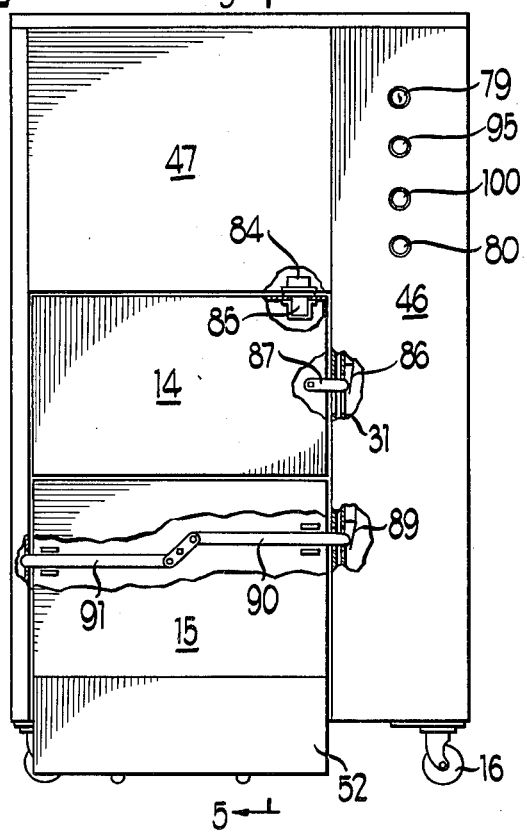
FIG. 4 is a front elevational view of the compactor with parts of the front panelling cut away to show the locking and safety switching devices therefor.

A shell comprised of appropriate panels of sheet metal forms the exterior top 42 (FIG. 6), sides 43 and 44, back 45 and front 36, 46 (FIG. 4) of the compactor cabinet. Front panel 46 covers only the narrow chamber 11, (FIG. 6) the power chamber 13 of wider cabinet chamber 12 being covered by its own panel 47 (FIG. 4).

Figure 2:
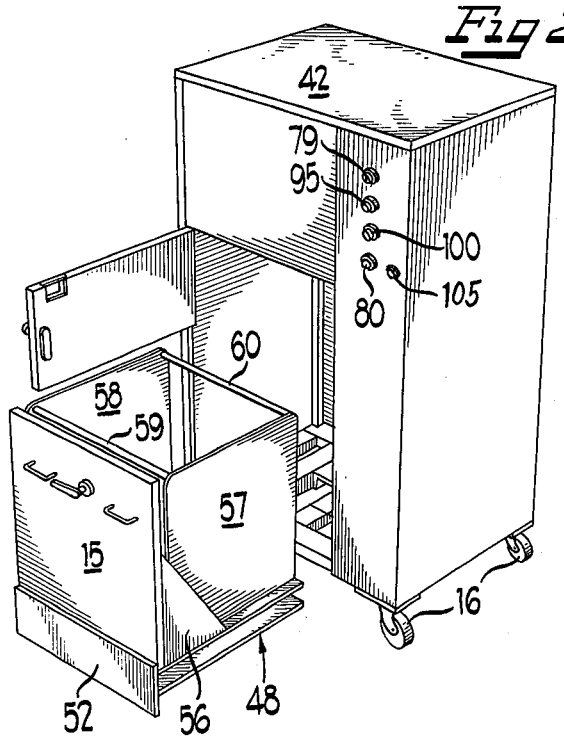
FIG. 2 is a right-front elevational view in perspective of the compactor of FIG. 1 showing the trash container thereof withdrawn from the compactor and the loading door open.

The trash-receiving receptacle in which the trash is compacted is in the form of a dolly 48 (FIGS. 2,5 and 6) having panel 15 as its front wall. Dolly 48 has a double bottom formed from vertically spaced horizontal plates 49 and 50 secured together by a central strut 51 and by a plate 52 (FIGS. 4 and 5) forming the lower part of panel 15. Strut 51 may be secured to plates 49 and 50 by threaded fasteners because of its relative inaccessability from the sides or rear of the dolly, but plate 52 is welded to both plates 49 and 50.

Bottom plate 50 is mounted on four rollers 53 of any suitable commercially available design, each of which is secured to a sub-plate 54, and each such plate 54 is in turn mounted through four springs 55 to bottom plate 50. Said springs collectively, i.e. all of the springs on all four rollers, are designed to support a fully loaded dolly with top plate 49 approximately ¼ inch above the base 18 (FIG. 3) of the compactor. The spacing between bottom plates 49 and 50 is greater than the thickness or vertical dimension of base 18 so that neither plate contacts base 18 when dolly 48 is fully loaded, but not subjected to compacting pressure. Dolly 48 can therefore be readily moved into and out of the compactor chamber 12 whether empty or loaded.

It is contemplated, however, that when dolly 48 is subjected to compacting pressure, springs 55 will yield and plate 49 will descend upon and be supported by base 18, thereby relieving rollers 53 of the compacting pressure.

Dolly 48 may be enclosed on four sides and have an open top to receive material to be compacted and subsequently to receive the compacting ram. In its preferred form (FIG. 2) however, dolly 48 is open at its top and rear, and its sides may consist of side plates 56, 57 supported by gusset plates 58 connecting the front panel 15 to the upper bottom plate 49.

Figure 7:
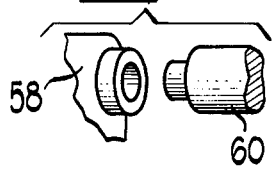
FIG. 7 is a fragmentary and exploded side elevation in perspective of the bag support for the container.

Removable rods 59 and 60 are provided connecting the tops of sides 57, 58 at the front and rear respectively of the dolly over which the upper end of a plastic trash bag (shown in dot-dash outline in FIG. 5) is folded. Rod 59 and 60 (FIG. 7) are interlocked with sides 57 and 58 by springing the sides to allow the ends of the rods to enter recessed bosses welded to the sides of the dolly. The frame of the compactor is relied upon to restrain the sides 57, 58 against excessive outward movement under compacting pressure.

Figure 5:
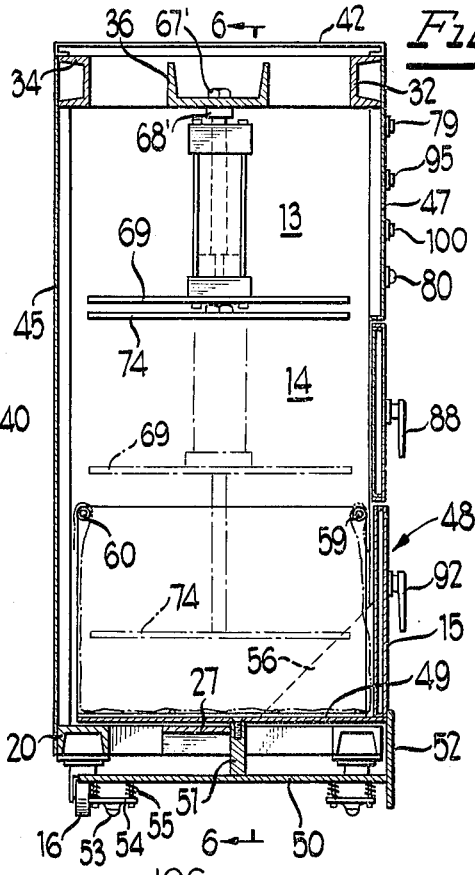
FIG. 5 is a side elevational view of the compactor in section, taken along line 5—5 of FIG. 4.
Figure 6:
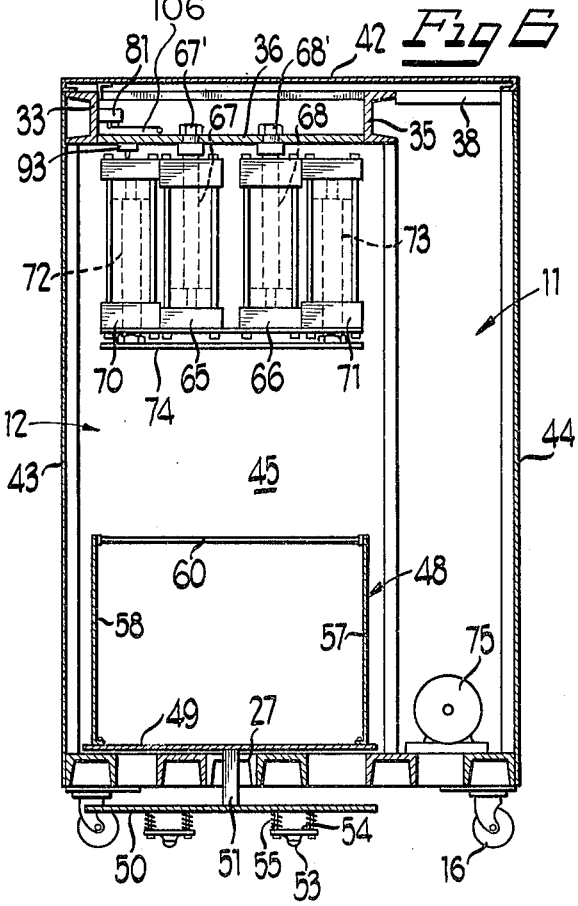
FIG. 6 is a front elevation view of the compactor in section taken along line 6—6 of FIG. 5.

The compacting mechanism is shown in FIGS. 5 and 6. It comprises a pair of transversely aligned hydraulic cylinders 65, 66 having their rods 67, 68 respectively secured rigidly to brace 36 as by having a threaded end on the rod which passes through appropriately formed holes in said brace 36, with nuts 67, 68 on opposite sides of the brace drawn together to lock each rod to the brace. The cylinders 65, 66 are, in turn, secured to a rigid support member or plate 69 by bolts or the like. Operation of the cylinders under compacting pressure causes the rods to remain stationary, but the cylinders and attached member or plate 69 descend toward dolly 48.

Secured to the upper side of rigid member 69 are cylinders 70, 71 whose rods 72, 73 extend freely through rigid member 69 and are secured to pressure plate or ram 74. When cylinders 70, 71 are energized, their rods 72, 73 push ram 74 downward with respect to support member 69. The energization of cylinders 70, 71 can take place concurrently with, or subsequent to the energization of cylinder 65, 66. In either event, ram 74 moves toward and into dolly 48 a distance which is substantially double the effective length of a cylinder, so that the height of the cabinet can be reduced by the length of the stroke of one cylinder.

Although all four cylinders 65, 66, 70 and 71 are shown in the drawings as being of substantially the same size, this is because they are also shown disposed in a straight line at right angles to brace 36. It may be observed that if cylinders 70 and 71 were disposed in a line at right angles to brace 36, the cylinder length could be increased by the vertical dimension of the brace, and the total travel of ram 74 could be thereby increased. The total desired travel of ram 74 is shown in dotted outline in FIG. 5, wherein ram 74 is shown within dolly 48 and more than half way thereinto. This total desired travel may be selected to suit the requirements of the user of the compactor.

Figure 8:
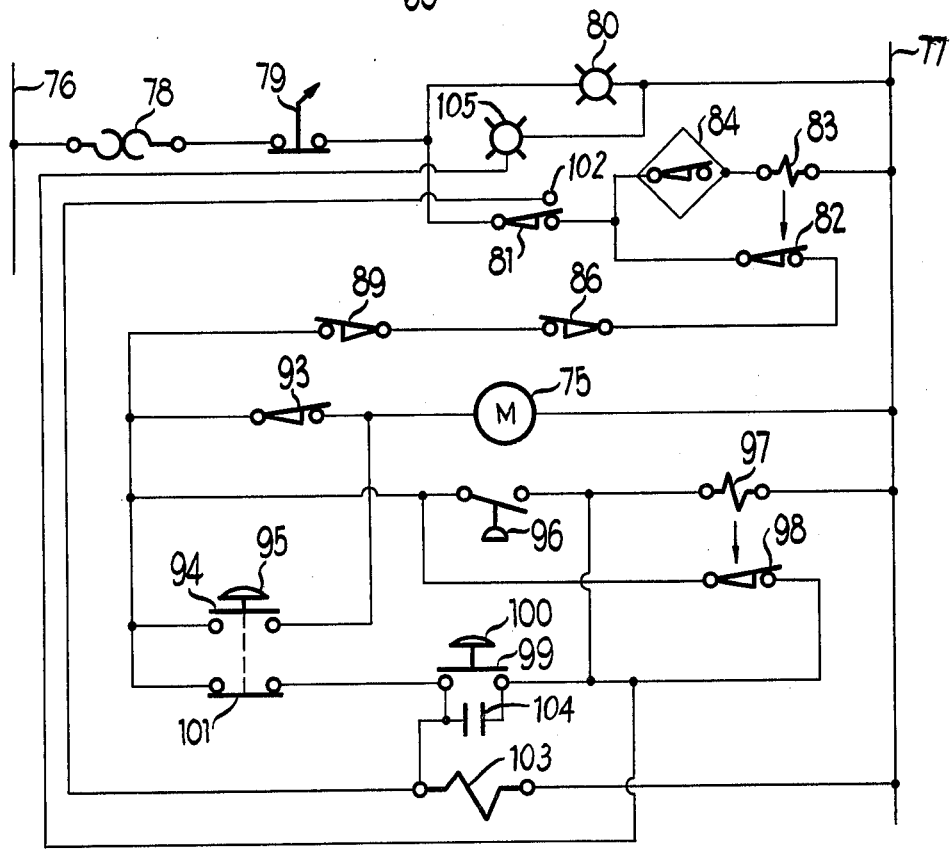
FIG. 8 is a wiring diagram for the controls and power system of the compactor.

The fluid under pressure for energizing cylinders 65, 66, 70 and 71 is provided by an electric motor driven pump shown schematically at 75 on base 18 in narrow chamber 11 and in FIG. 8. The pump is connected through solenoid-operated valves (not shown) to cylinders 65, 66, 60, 71. The controls for the motor and valves are shown schematically in FIG. 8 to which reference is now made.

In FIG. 8, the two leads from the power line are shown at 76 and 77, the latter being the ground. Shown schematically at 78 is a 15A, 120V circuit breaker connected at one side to line 76 and at its other side to a key-operated switch 79 of known construction. A green indicator light 80 is connected in series with switch 79 and ground 77, and lights up when switch 79 is on. A stress deflection limit switch 81 operated by a deflection of 1/32 inch of brace 36 (FIG. 6) is also in series with key operated switch 79 and with a limit switch 82 designed to be "on" when loading door 14 is closed. Said switch 81 has a switch arm 106 which extends over an area of brace 36 deflected by rods 67 and 68 of cylinders 65 and 66 respectively.

Limit switch 82 is not operated directly by door 14, but is activated by a solenoid 83 in series with line 77 and with a magnetically operated switch 84 (FIG. 4) mounted on the lower edge of power chamber panel 47. A permanent magnet 85, mounted in loading door 14, is designed to be in operative position with respect to switch 84 only when said loading door is closed. When loading door 14 is even slightly open, relay 83 is de-energized and switch 82 is open thereby breaking the circuit from line 76 to the motor 75 to stop the motor.

Three other switches are in series between switch 82 and motor 75, each of which is capable of shutting off motor 75. The first of these is switch 85 (FIG. 4) which is mounted in the front vertical square sectioned tubular frame member 31. It is a microswitch and is operated by the mechanical latch 87 which locks loading door 13 in closed position. The latch itself is a rotating latch operated by an exterior handle 88 (FIG. 5).

The second of the three series switches is another microswitch 89 (FIG. 4), also mounted on the front vertical square-sectioned tubular frame member 31, but below switch 86 and operated by a latch 90 on front panel 15 of dolly 48 and used to lock dolly 48 in place in the compactor cabinet when the compacting cycle is in progress. Said dolly latch 90 is a double one in that it has an extension 91 (FIG. 4) which enters an opening in, and engages the corner vertical square section frame member 17 (FIG. 3). Dolly latch 90 is operated by an external oscillatable handle 92 (FIG. 5).

The third of the three series switches is a limit switch 93 (FIG. 6) mounted on the underside of brace 36 and actuated by cylinder 70 when the latter returns to its uppermost position. This switch is circumvented, when it is desired to start a new compacting cyle, by a green manual push-button type switch 94 connected across limit switch 93. The button 95, for operating switch 94, is located at the front of the compactor cabinet in the panel enclosing narrow chamber 11 (FIG. 1 and 2) and may be labeled "START".

Shown schematically and serially connected to switches 93 and 94 is the motor and pump 75 for providing the hydraulic fluid under pressure for operating compacting cylinders 65, 66, 70 and 71. The pressurized fluid is fed through solenoid-operated valves (not shown) alterntely to one side or the other of the cylinders to extend them for the compacting cycle or to contract them to withdraw ram 74.

The downward compacting movement of cylinders 65, 66, 70 and 71 continues until an obstruction is encountered, such as a compacted quantity of trash. As the trash is compacted, the pressure of the fluid in the cylinders rises. At a predetermined pressure, a pressure operated switch 96 in the hydraulic system from the pump, is actuated to close a circuit through a solenoid 97. The latter, thus energized, closes a switch 98 which by-passes switch 96 to maintain solenoid 97 actuated. This is necessary since, as soon as pressure on switch 96 is relaxed, said switch 96 opens to de-energize solenoid 97.

Said solenoid, however, also operates the valves to cylinders 65, 66, 70 and 71 to reverse the pressure in the cylinders to raise said cylinders and the compacting ram 74 out of the dolly and loading chamber.

In the event of an emergency requiring an immediate retraction of ram 74, an emergency switch 99 is provided, the switch being mounted on the front panel of the cabinet below "START" switch 94 and operated by a red button 100. Switch 99 is connected in series with solenoid 97 on one side, and on the other, through a normally made switch 101 operated by start button 94, to the series of switches 89, 86, 82, 81 closing the circuit to key switch 79. Thus when emergency switch 99 is closed, solenoid 97 reverses cylinders 65, 66, 70 and 71 and maintains them in reversed condition until limit switch 93 is opened by cylinder 70 to shut off motor 75 and its associated pump. It may be noted that as soon as solenoid 97 is energized and switch 98 is closed, emergency button 100 may be released without thereby de-energizing solenoid 97 since an alternate circuit is immediately establish to solenoid 97 through switch 98.

Should a solid obstruction such as a block of wood, piece of metal or the like be encountered and pressure switch 96 fail to close to reverse the operation of the cylinders, the excessive pressure developed by the cylinders will cause brace 36 to deflect and switch 81 to open. However, switch 81 is a double throw switch and will make a circuit through its second contact 102 to a relay 103 which then closes a switch 104 in parallel with emergency switch 99. This causes the cylinders to reverse their movement and thus relieve the excessive pressure on brace 36. The reverse movement will continue as in an emergency operation of switch 99 and ultimately come to a stop. Meanwhile, a red light 105, located on the front panel of the compactor is lit to indicate that an obstruction in the trash must be removed. It is understood that the foregoing description is merely illustrative of a preferred embodiment of the invention and that the scope of the invention therefore is not to be limited thereto, but is to be determined by the appended claims.

I claim:

1. A trash compactor comprising a frame having spaced upper and lower braces, vertical posts rigidly connecting said upper and lower braces, a shell covering said frame, said shell forming upper, middle and lower compartments in said frame, an opening in said shell providing access to the middle and lower compartments, a dolly having an open top to receive trash to be compacted, said dolly occupying the lower compartment, a door closing the middle compartment and through which trash is loaded into the open top of the dolly, and means in the upper compartment for compacting the trash in the dolly, said compacting means comprising a plate, a ram below the plate, a pair of hydraulic cylinders connected between the upper brace and plate to lower said plate with reference to the brace, and a second pair of hydraulic cylinders mounted on the plate and connected to the ram to lower the ram with reference to the plate.

2. A trash compactor, as described in claim 1, all of said cylinders being disposed between the plate and the upper brace, whereby to reduce the height of the upper compartment.

3. A trash compactor comprising a frame having spaced upper and lower braces, vertical posts rigidly connecting said upper and lower braces, a shell covering said frame, said shell forming upper, middle and lower compartments in said frame, an opening in said shell providing access to the middle and lower compartments, a dolly having an open top to receive trash to be compacted, said dolly occupying the lower compartment, a door closing the middle compartment and through which trash is loaded into the open top of the dolly, and means in the upper compartment for compacting the trash in the dolly, said compacting means comprising a plate, a ram below the plate, a pair of hydraulic cylinders connected between the upper brace and plate to lower said plate with reference to the brace, and a second pair of hydraulic cylinders mounted on the plate and connected to the ram to lower the ram with reference to the plate, and including means for providing fluid under pressure to said hydraulic cylinders, said means comprising a pump, means for driving the pump, switch means supported from a vertical post for controlling the pump driving means and having an arm adjacent a central region of one of said upper and lower braces and adapted to be contacted by said one of said upper and lower braces when it is deflected a predetermined amount under pressure of said hydraulic cylinders, whereby to disable said pump driving means by the operation of said switch means.

4. A trash compactor comprising a frame having spaced upper and lower braces, vertical posts rigidly connecting said upper and lower braces, a shell covering said frame, said shell forming upper, middle and lower compartments in said frame, an opening in said shell providing access to the middle and lower compartments, an open-top dolly in which trash is to be compacted, said dolly occupying the lower compartment and having a wall closing said lower compartment when the dolly is in position to have trash compacted therein, a door closing the middle compartment, a latch for locking said door in closed position, electrically controlled means on the frame for generating compacting pressure for trash in the dolly, a first switch means operated by the latch for preventing operation of the electrically controlled means when the door is unlatched, and a second switch means independent of the latch, for preventing operation of the electrically controlled means except when the door is in closed position said electrically controlled means on the frame for generating compacting pressure for trash in the dolly comprising hydraulic cylinders, said frame including upper and lower braces, vertical posts rigidly connecting the upper and lower braces, a plate, a ram below the plate, a pair of hydraulic cylinders connected between the upper brace and plate to lower said plate with reference to the brace, a second pair of hydraulic cylinders mounted on the plate and connected to the ram through the plate to lower the ram with reference to the plate, means for providing fluid under pressure to said hydraulic cylinders, said last named means comprising a pump, means for driving the pump, switch means supported from one of said vertical posts for controlling the pump driving means and having an arm adjacent a deflectable region of one of said upper and lower braces and adapted to be contacted by said one of said upper and lower braces when it is deflected a predetermined amount under pressure of said hydraulic cylinders, whereby to break the circuit to said pump driving means by the operation of said switch means.

5. A trash compactor, as described in claim 4, and warning means operated by said switch means supported from a vertical post when said predetermined amount of deflection is reached.

6. A trash compactor, as described in claim 5, said warning means comprising a visual signal mounted on the shell.

7. A trash compactor, as described in claim 4, and means controlled by said switch means supported from a vertical post, for reversing the operation of said hydraulic cylinders when said one of said upper and lower beams is deflected said predetermined amount.

8. A trash compactor, as described in claim 4, said first and second switch means and said switch means supported from said post being connected in series.

9. A trash compactor comprising a frame having spaced upper and lower braces, vertical posts rigidly connecting said upper and lower braces, a shell covering said frame, said shell having an opening in one side, a dolly adapted to be moved into said opening, said dolly having an open top, a bottom adapted to overlie the lower brace such that said lower brace extends under the central region of the bottom of the dolly, roller means for supporting the dolly from the floor, resilient means interposed between the roller means and dolly, and means intermediate the upper and lower braces for exerting pressure upon the dolly, whereby said resilient means is compressed until the bottom of the dolly rests upon said lower brace and thereafter increased downward pressure on the dolly is taken by the lower brace, said dolly comprising further a frame member spaced from the said bottom of the dolly and extending under the said bottom, said resilient means being secured to said dolly frame member, and rigid means connecting the said dolly frame member to said bottom of the dolly.

10. A trash compactor, as described in claim 9, said compactor frame having a bottom formed with a slot to receive the rigid means connecting the said dolly frame member to said bottom of the dolly.

* * * * *